United States Patent [19]

Kubo

[11] 4,411,196

[45] Oct. 25, 1983

[54] IMPRINTER WITH LOCKING AND RELEASING DEVICE

[75] Inventor: Keizo Kubo, Hachioji, Japan

[73] Assignee: Janome Sewing Machine Co. Ltd., Tokyo, Japan

[21] Appl. No.: 348,454

[22] Filed: Feb. 12, 1982

[30] Foreign Application Priority Data

Feb. 24, 1981 [JP] Japan ..... 56-24860

[51] Int. Cl.[3] ..... B41F 3/20

[52] U.S. Cl. ..... 101/269

[58] Field of Search ..... 101/269–274, 101/45, 56

[56] References Cited

U.S. PATENT DOCUMENTS

| | | | |
|---|---|---|---|
| 3,279,369 | 10/1966 | Wight | 101/269 |
| 3,486,446 | 12/1969 | Maul et al. | 101/269 |
| 3,572,241 | 3/1971 | Waterman | 101/269 |
| 3,705,548 | 12/1972 | Waterman | 101/269 |
| 3,735,701 | 5/1973 | Ackerman | 101/269 |
| 3,795,191 | 3/1974 | Miller et al. | 101/269 |

*Primary Examiner*—Edward M. Coven

*Attorney, Agent, or Firm*—Michael J. Striker

[57] ABSTRACT

An imprinter particularly for credit cards, includes a printing bed, a support secured to one end of the printing bed and two spaced guide frames turnably supported on the support and provided with elongated guide grooves receiving rollers of a carriage supporting a printing roller. The carriage is turnable together with the guide frames between an operative position in which the carriage is on the printing bed and an inoperative position in which the carriage is away from the printing bed. The support includes two portions bent downwardly and spaced from each other and each being provided with an inclined edge and a vertical edge. A transverse shaft mounted between guide frames engages with the vertical edges of the respective portions of the support to lock the frames and the carriage in the operative position. The imprinter further includes carriage-releasing member swingably mounted on the guide frames and operatively connected to an actuating transverse shaft extended between the frames and engageable with additional links each arranged outside of the respective guide frame and adapted to disengage the first mentioned transverse shaft from the vertical edges of the bent portions of the support.

4 Claims, 2 Drawing Figures

IMPRINTER WITH LOCKING AND RELEASING DEVICE

BACKGROUND OF THE INVENTION

The invention relates to an imprinter, and more particularly relates to a carriage locking and releasing device of the imprinter of a type having a carriage supporting a printing roller, which is mounted on a printing bed and is turnably moved between an operative position, in which the carriage is on the printing bed, and an inoperative position in which the carriage is away from the printing bed.

SUMMARY OF THE INVENTION

It is therefore a primary object of the invention to provide an imprinter with a carriage locking and releasing device which is simple in structure and easy in operation.

It is another object of the invention to provide an imprinter efficiently operated to produce a clear and accurate printing effects.

It is still another object of the invention to provide an imprinter which is easily assembled and disassembled.

It is still another object of the invention to provide an imprinter having a carriage supporting a printing roller, which is locked and released to and from a printing bed in a course of printing operation.

It is still further object of the invention to provide an imprinter which is compact and easy in manual transportation.

It is still another object of the invention to provide an imprinter which is prevented from double printing.

The other features and advantages of the invention will be apparent from the following description of a preferred embodiment in reference to the attached drawings.

DETAIL DESCRIPTION OF THE INVENTION

Figure 1:
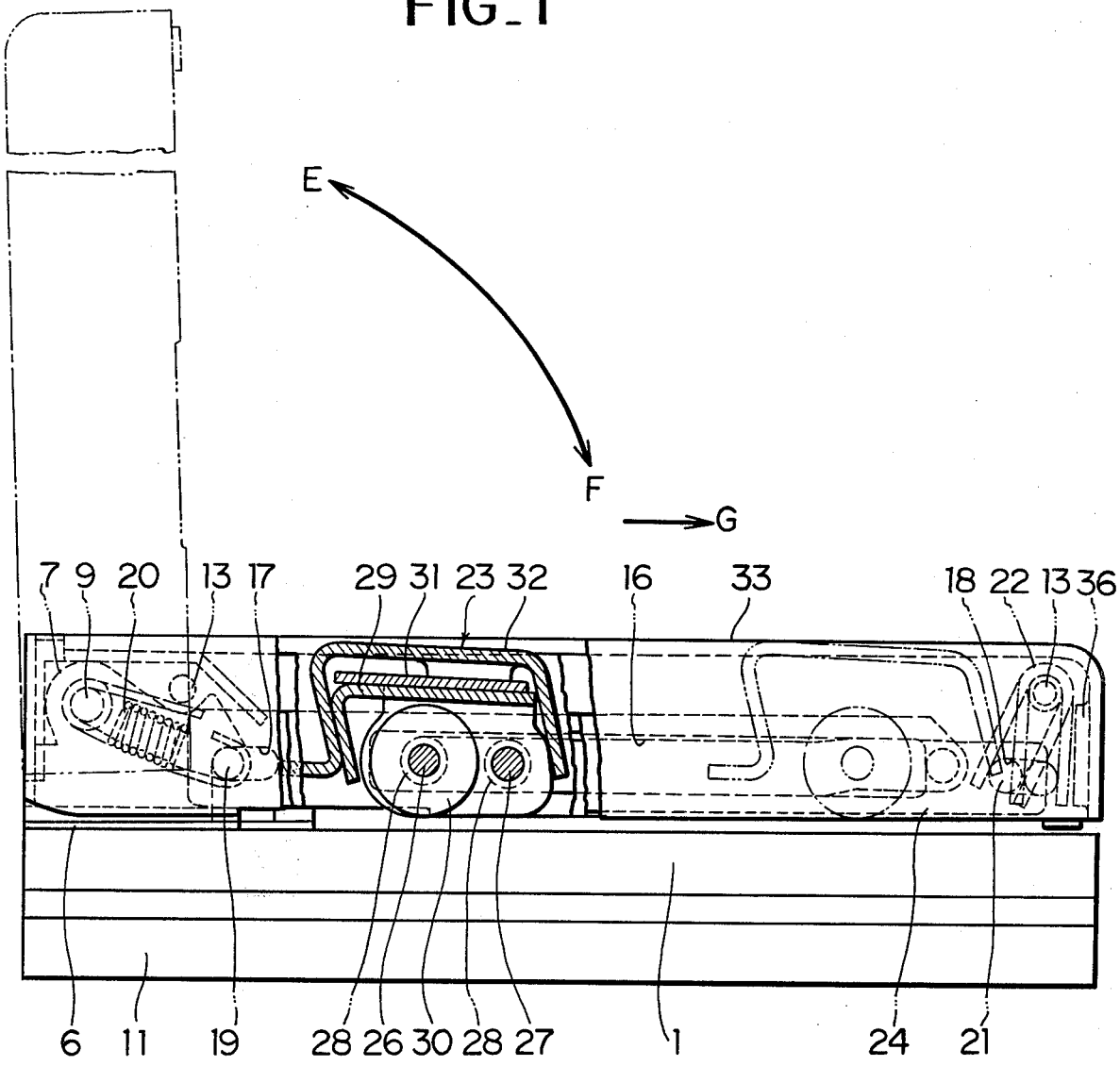
FIG. 1 is a side elevational view of the invention shown partly in section.
Figure 2:
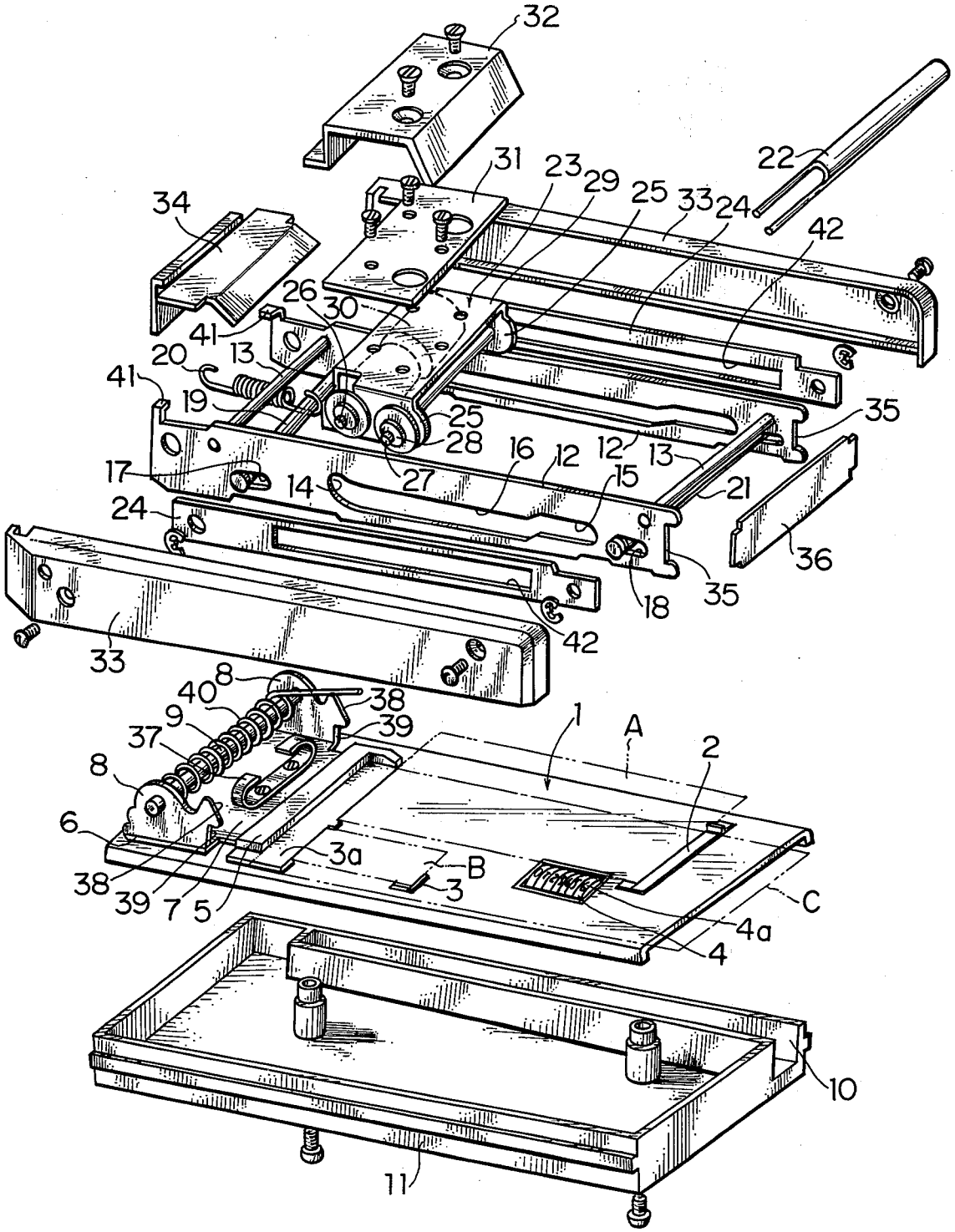
FIG. 2 is an exploded perspective view of the embodiment of the invention.

The invention will be explained in reference to the preferred embodiment as shown in FIGS. 1 and 2. The reference numeral 1 is a printing bed which is thereon provided with a frame 2 and another frame 3 for positioning a customer's credit card A and a shop name plate B on the printing bed 1 respectively in cooperation with still another frame 3*a* which is spaced from the frames 2, 3 on the bed 1 and is commonly used with the frames 2 and 3. The printing bed 1 is also provided thereon with still another frame 5 adjacent to the frame 3*a* to position a slip C on the printing bed in cooperation with the frame 2 as shown in FIG. 2. The printing bed 1 is formed with an opening 4*a* through which a set of dating wheels 4 is partly protruded up for imprinting the data on the slip C. The printing bed 1 is fixedly mounted on a base 11 which is provided with a space 10 for receiving a writing instrument such as a ball-pen.

The printing bed 1 has a support 7 secured to one end thereof with an elastic plate 6 located therebetween. The support 7 is formed with upstanding frames 8, 8 at both ends thereof. An eccentric shaft 9 is extended between the upstanding frames 8 and has both ends protruded out of the upstanding frames, respectively. A pair of guide frames 12, 12 are at one end thereof turnably mounted on the both protruded ends of the eccentric shaft 9 respectively. The guide frames 12, 12 are connected with a predetermined space therebetween by a pair of spaced transverse shafts 13, 13. The guide frames 12, 12 are each formed with a guide groove 16 which is upwardly directed at one end 14 and is horizontally extended at a higher level at the opposite end 15. As shown, the guide frames 12, 12 are each formed with a short groove 17 at one end part thereof which engages each end of a transverse shaft 19. A tension spring 20 (also shown in FIG. 1) is at one end connected to the eccentric shaft 9 and is at the opposite end connected to the transverse shaft 19. The guide frames 12, 12 are each formed at the other end part with a short groove 18 which engages each end of another transverse shaft 21. As shown in FIG. 1, one of the transverse shafts 13 and shaft 21 are covered with an inverted U- shape member 22 which is turnable on the upper transverse shaft 13. A printing carriage 23 is mounted on the guide frames 12, 12 and is movable along the guide grooves 16, 16 of the guide frames.

The transverse shafts 19, 21 have both ends each protruded out of the guide frames 12, 12 and connected to a pair of links 24, 24 located on the outside of the guide frames 12, 12. The links 24, 24 are each formed with a groove 42 of the same length with the guide grooves 16, 16 of the guide frames 12, 12. The carriage 23 has vertical walls 25, 25 bent down at both ends thereof between the guide frames 12, 12. The carriage 23 supports a roller shaft 26 and a guide shaft 27 rotatably between the vertical walls 25, 25 thereof. These shafts are each protruded at both ends thereof outwardly of the opposite vertical walls 25, 25, and each carry guide rollers 28, 28, 28, 28 on the protruded ends thereof, which are each in engagement with the guide grooves 16, 16 of the guide frames 12, 12. As shown, the carriage 23 consists of a rack 29, a rectangular plate 31 placed on the rack 29, a cover 32 and a printing roller 30 mounted on the transverse shaft 26. The printing roller 30 may be impregnated with ink or may not be impregnated with ink. The rectangular plate 31 is at both ends thereof normally in sliding engagement with the respective inner sides of the guide frames 12, 12 so that the carriage 23 may be prevented from swinging or inclining to and fro during the printing movement of the carriage 23 along the guide frames 12, 12.

Each of the guide frames 12, 12 has a frame cover 33 secured to the outer side thereof so as to prevent the roller shaft 26 and the guide shaft 27 from being dropped from the rack 29 and also to prevent the inverted U-shape member 22 from being dropped from the transverse shaft 13. As shown, a cover 34 is mounted on one end of the guide frames 12, 12 to cover the transverse shafts 13, 19 of the frames 12, 12 and the support 7 on the printing bed 1. A cover plate 36 is fitted into the opposite recesses 35, 35 respectively formed at the other end of the guide frames 12, 12. The cover 34 and cover plate 36 are also prevented from being dropped from the guide frames 12, 12 by the frame covers 33, 33.

A cushion spring 37 (FIG. 2) is secured to the support 7 between the upstanding frames 8, 8 thereof. The cushion spring 37 is pressed down by one of the transverse shafts 13 of the guide frames 12, 12 when the guide frames 12, 12 are turned down onto the printing bed 1 around the eccentric shaft 9. Thus the cushion spring 37 maintains the printing roller 30 of the carriage 23 at a predetermined position above the upper face of the printing bed 1. The upstanding frames 8, 8 of the support 7 are each formed with a part providing an inclined edge 38 and a vertical edge 39 which is located below the inclined edge 38. A coiled spring 40 is mounted around the eccentric shaft 9, and has one end pressed against the support 7 and the other end pressed against the guide frames 12, 12. As shown, the guide frames 12, 12 are each provided with an upper projection 41 at one end thereof. These upper projections 41, 41 act as the stoppers to engage the upstanding frames 8, 8 respectively when the guide frames 12, 12 are turned up at least 90° around the eccentric shaft 9 from the position where the guide frames 12, 12 are down on the printing bed 1. Thus the upper projections 41, 41 maintain the guide frames 12, 12 as they stand up on the support 7 as shown in FIG. 1.

With such a combination of components, the invention operates as follows: In reference to FIG. 1, if the inverted U-shape member 22 is turned towards the cover plate 36 and then the guide frames 12, 12 are turned up in the counterclockwise direction around the eccentric shaft 9 as shown by arrow E from the position where the guide frames 12, 12 are down on the printing bed 1, the guide frames 12, 12 are continuously turned due to the action of the coiled spring 40 until the upper projections 41, 41 come to engage the respective upstanding frames 8, 8 of the support 7, and then the guide frames 12, 12 are held on the support 7 as they stand up in a condition released from the printing bed 1.

If the guide frames 12, 12 are turned down against the action of coiled spring 40 in the clockwise direction as shown by arrow F towards the printing bed 1 after the dating wheels are properly set and the credit card A, the shop name plate B and the slip C are placed in the predetermined positions respectively on the printing bed 1, the transverse shaft 19 on the guide frames 12, 12 engages the inclined edges 38, 38 of the upstanding frames 8, 8 and slides down the edges within the respective short grooves 17, 17 against the action of the tension spring 20. When the transverse shaft 19 comes to engage the vertical edges 39, 39 below the inclined edges 38, 38 the shaft 19 is pulled back by the tension spring 20. Thus the guide frames 12, 12 are locked in the lower printing position.

Then if the carriage 23 is moved from the initial position as shown by the solid lines in FIG. 1 in the rightward direction as shown by arrow G, the guide rollers 28, 28 of the transverse shaft 26 come down from the upper parts 14, 14 of the guide grooves 16, 16 to the lower horizontal part thereof. Accordingly, the printing roller 30 on the shaft 26 comes down onto the printing bed 1, and is rotated on the slip C with a suitable pressure along the printing bed 1. The printing roller 30 is again lifted up at the end part of the printing bed 1 when the guide rollers 28, 28 come to enter the upper horizontal parts 15, 15 of the guide groove 16. Further when the carriage 23 comes to engage the inverted U-shape member 22 and turn the same in the counterclockwise direction around the shaft 13, the transverse shaft 21 is moved in the rightward direction within the short grooves 18, 18 of the respective guide frames 12, 12 as shown by the phantom lines in FIG. 1. In this process, the both ends of the shaft 21 engage the respective rightward ends of the grooves 42 of the links 24, 24 each arranged on the outside of each of the guide frames 12, 12, and move the links 24, 24 in the same direction. Accordingly the transverse shaft 19 is moved in the rightward direction within the short grooves 17, 17 against the action of the tension spring 20, and is disengaged from the respective vertical edges 39, 39 of the upstanding frames 8, 8. Then the cushion spring 37 presses up the shaft 19, and the shaft 19 engages the inclined edges 38, 38 if the operator applies no pressure to the carriage 23 at the end of printing operation.

Thus the guide frames 12, 12 are slightly turned in the counterclockwise direction due to the action of the cushion spring 37 if the operating force of carriage 23 is deprived of at the end of printing operation, and the printing roller 30 is brought up above the upper face of the printing bed 1. The printing roller 30, therefore, will not blot the slip C on the printing bed if the carriage 23 is moved along the guide frames 12, 12 at the end of printing operation.

At the end of the printing operation, if the guide frames 12, 12 are turned up in the counterclockwise direction as shown by the arrow E in FIG. 1, the carriage 23 is returned by its own weight to the initial position as illustrated by the solid lines, and the printed slip C can be taken out from the printing bed 1. Further the elastic plate 6 arranged between the printing bed 1 and the support 7 enables the printing roller 30 to absorb the possible unevenness in the height of date placed on the printing bed to be printed on the slip C. As a result a clear and accurate printing effect is obtained.

It will be understood that each of the elements described above, or two or more together, may also find a useful application in other types of imprinters differing from the types described above.

While the invention has been illustrated and described as embodied in an imprinter, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In an imprinter with a locking and releasing device, having an elongated printing bed and a carriage supporting a printing roller and mounted on the printing bed for moving thereacross by means of guide rollers of the carriage to imprint a form with the types arranged on the printing bed, said carriage being turnable to and away from the printing bed between an operative position in which the carriage is on the printing bed and an inoperative position in which the carriage is away from the printing bed, the improvement comprising:

support means (7) including a pair of upright portions (8) projecting outwardly from the printing bed and spaced from each other, each of said upright portions being formed with an inclined edge (38) and a vertical edge (39) forming a carriage locking structure;

a unit of guide frames (12) each mounted at one end thereof on the support means for carrying the carriage thereon and turnable to and away from the printing bed, said guide frames being each formed with an elongated guide groove (16) for engaging each of the guide rollers of the carriage, said guide frames being each further formed with first and second grooves (17, 18) opposite to each other with respect to the elongated guide groove;

engaging means including a first transverse shaft (19) having both ends engaging the first grooves of the guide frames, respectively and being movable with respect to the latter;

actuating means including a second transverse shaft (21) having both ends engaging the second grooves of the guide frames, respectively and being movable with respect to the latter;

means (24, 24) for connecting the first and second transverse shafts to each other;

swingable means (22) mounted on the unit of guide frames and engaging the second transverse shaft (21), so that the swingable means may be moved in association with the first and second transverse shafts;

first spring means (20) normally biasing the first and second transverse shafts in one direction to hold the first transverse shaft in cooperation with the carriage locking structure of said support means when the carriage and the unit of guide frames are in the operative position of the printing bed; and second spring means (40) normally biasing the unit of guide frames together with the carriage toward the inoperative position away from the printing bed, said swingable means being adapted to move in a direction to release the first transverse shaft and accordingly the unit of guide frames from the locking structure of said support means when the carriage is moved to a position for swinging the swingable means at the end of printing operation, and said second spring means moving the unit of guide frames together with the carriage into the inoperative position away from the printing bed.

2. An imprinter as defined in claim 1, further comprising a cushion spring (37) arranged on the support means for biasing said first transverse shaft (19) in the upward direction when the unit of guide frames is locked in the operative position by the carriage locking structure.

3. An imprinter as defined in claim 2, wherein each of said guide frames is provided with a projection at one end thereof, said projections cooperating with said carriage locking structure to lock the carriage and the unit of guide frames in the inoperative position.

4. An imprinter as defined in claim 3, further including an eccentric shaft positioned between said upright portions and having ends protruding outwardly of the upright portions, said guide frames being turnable on said protruding ends.

* * * * *